US011084304B2

(12) United States Patent
Nakai et al.

(10) Patent No.: US 11,084,304 B2
(45) Date of Patent: Aug. 10, 2021

(54) CASSETTE INCLUDING GUIDE FOR RESTRAINING DISENGAGEMENT OF TAPE

(71) Applicant: BROTHER KOGYO KABUSHIKI KAISHA, Nagoya (JP)

(72) Inventors: Shimako Nakai, Iwakuni (JP); Shota Iijima, Nagoya (JP); Arisa Noda, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 2 days.

(21) Appl. No.: 16/833,901

(22) Filed: Mar. 30, 2020

(65) Prior Publication Data

US 2020/0406654 A1 Dec. 31, 2020

(30) Foreign Application Priority Data

Jun. 28, 2019 (JP) ..... JP2019-121206

(51) Int. Cl.
*B41J 32/02* (2006.01)
*B41J 2/32* (2006.01)

(52) U.S. Cl.
CPC *B41J 32/02* (2013.01); *B41J 2/32* (2013.01)

(58) Field of Classification Search
CPC ..... B41J 32/02; B41J 32/00; B41J 2/32; B41J 3/4075; B41J 15/044; B41J 15/046; B41J 33/003
See application file for complete search history.

(56) References Cited

U.S. PATENT DOCUMENTS

2010/0123282 A1* 5/2010 Miyakoshi ..... H04N 1/00572 271/3.19
2010/0329764 A1 12/2010 Yamaguchi et al.
2011/0008090 A1* 1/2011 Yamaguchi ..... B65H 41/00 400/613
2012/0189365 A1 7/2012 Yamaguchi
(Continued)

FOREIGN PATENT DOCUMENTS

EP 2 514 600 A1 10/2012
JP H05-162402 A 6/1993
JP H06-179277 A 6/1994
(Continued)

OTHER PUBLICATIONS

Extended European Search Report for the related European Patent Application No. 20165641.0 dated Jan. 27, 2021.

*Primary Examiner* — Kristal Feggins
(74) *Attorney, Agent, or Firm* — Kenealy Vaidya LLP

(57) ABSTRACT

A cassette includes: a tape having a first surface and a second surface opposite each other; an ejecting portion for discharging the tape in a conveying direction; and a guide provided at the ejecting portion. The tape has a thickness in a first direction defined as a direction from the first surface to the second surface. The guide includes a first region in contact with the first surface of the tape at the guide, and second and third regions in contact with the second surface of the tape at the guide. The first region is positioned between the second region and the third region in a widthwise direction of the tape perpendicular to the first direction. The first region is positioned further in the first direction of the tape at the guide relative to the second region and the third region.

28 Claims, 8 Drawing Sheets

(56) References Cited

U.S. PATENT DOCUMENTS

2013/0021622 A1* 1/2013 Yamaguchi ..... B41J 11/703
358/1.6

FOREIGN PATENT DOCUMENTS

| | | | |
|---|---|---|---|
| JP | 2007-203521 | A | 8/2007 |
| JP | 2010-99852 | A | 5/2010 |
| JP | 2011-11414 | A | 1/2011 |
| JP | 2012-035637 | A | 2/2012 |

* cited by examiner

CASSETTE INCLUDING GUIDE FOR RESTRAINING DISENGAGEMENT OF TAPE

CROSS REFERENCE TO RELATED APPLICATION

This application claims priority from Japanese Patent Application No. 2019-121206 filed Jun. 28, 2019. The entire content of the priority application is incorporated herein by reference.

TECHNICAL FIELD

The present disclosure relates to a cassette attachable to a printer.

BACKGROUND

There has been known a cassette attachable to a printer. For example, Japanese Patent Application Publication No. 2011-011414 discloses a tape printer to which a tape cassette is attachable. After printing is performed on a tape retained in the tape cassette by a thermal head, the tape is ejected out of a tape ejection portion of the tape cassette through a pair of restriction members. The ejected tape is discharged through a discharge slit of the tape printer.

SUMMARY

However, in the above conventional tape printer, if the tape is in contact with the tape ejection portion with a relatively small area, a leading end portion of the tape may be moved upstream in a tape conveying direction to be deviated from the tape ejection portion, so that the tape cannot be discharged out of the tape cassette.

In view of the foregoing, it is an object of the disclosure to provide a cassette capable of suppressing disengagement of a tape from a tape ejection portion of the cassette.

In order to attain the above and other objects, according to one aspect, the disclosure provides a cassette including a tape, an ejecting portion, and a guide. The tape has a first surface and a second surface opposite each other. The tape has a thickness in a first direction defined as a direction from the first surface to the second surface, and the tape has a width in a widthwise direction perpendicular to the first direction. The ejecting portion is configured to discharge the tape in a conveying direction. The guide is provided at the ejecting portion and is configured to guide the tape in the conveying direction. The guide includes: a first region in contact with the first surface of the tape at the guide; a second region in contact with the second surface of the tape at the guide; and a third region in contact with the second surface of the tape at the guide. The first region is positioned between the second region and the third region in the widthwise direction of the tape at the guide. The first region is positioned further in the first direction of the tape positioned at the guide relative to the second region and the third region.

According to another aspect, the disclosure provides a cassette including a tape, an ejecting portion, and a guide. The tape has a first surface and a second surface opposite each other. The tape has a thickness in a first direction defined as a direction from the first surface to the second surface, and the tape has a width in a widthwise direction perpendicular to the first direction. The ejecting portion is configured to discharge the tape in a conveying direction. The guide is provided at the ejecting portion and is configured to guide the tape in the conveying direction. The guide includes: a first region in contact with the first surface of the tape at the guide; a second region in contact with the second surface of the tape at the guide; and a third region in contact with the second surface of the tape at the guide. The first region is positioned between the second region and the third region in the widthwise direction of the tape at the guide. At the guide, the tape in contact with each of the first region, the second region and the third region is deformed to be convex in the first direction.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Figure 1:
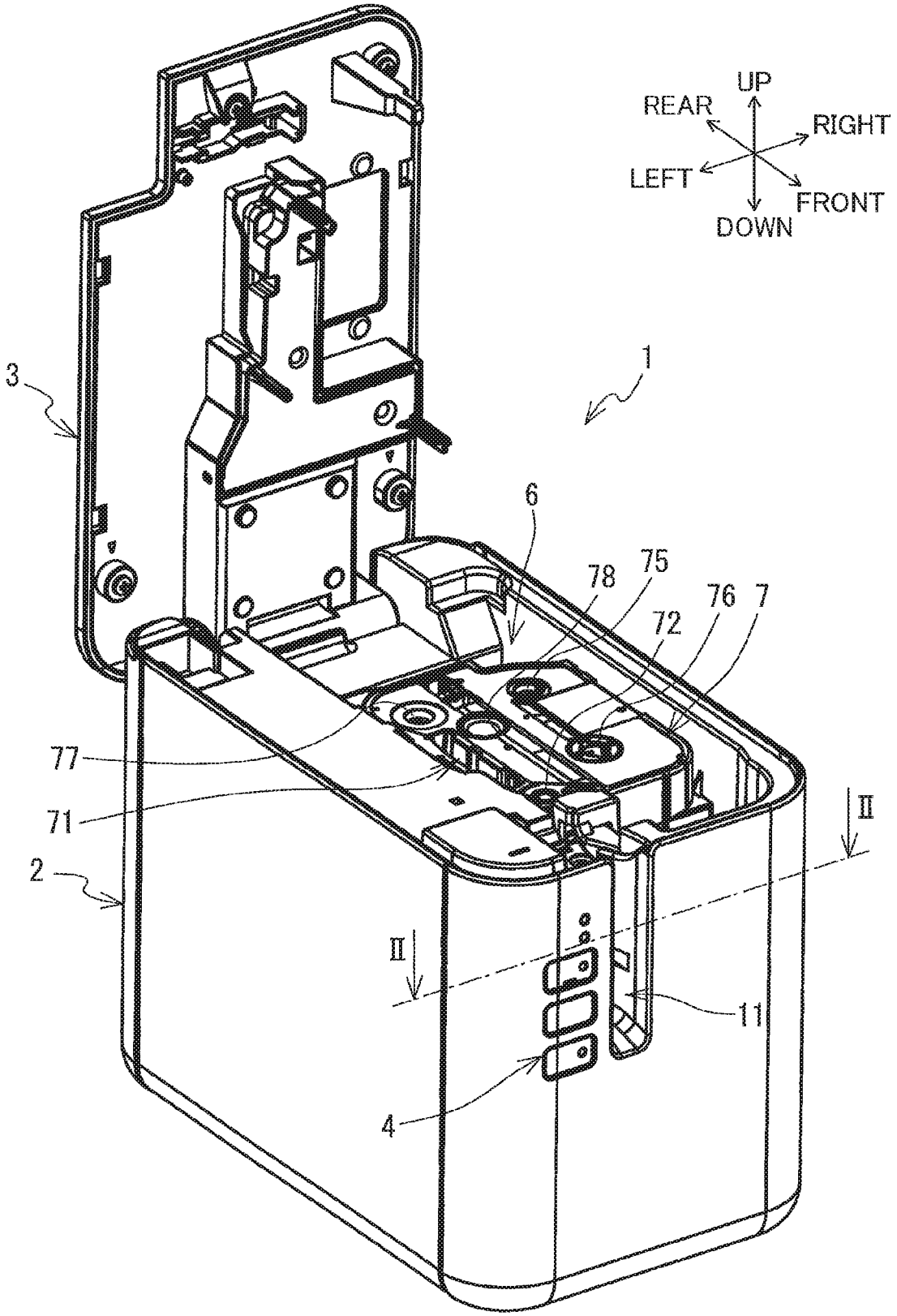
FIG. 1 is a perspective view of a printer to which a cassette 7 according to one embodiment of the disclosure is attached.

Hereinafter, a cassette 7 according to one embodiment of the present disclosure and a printer 1 to which the cassette 7 is attachable will be described with reference to accompanying drawings. Configurations of the cassette 7 illustrated in the drawings are merely exemplary and do not intend to limit the present disclosure.

In the following description, a diagonally lower left side, a diagonally upper right side, a diagonally lower right side, a diagonally upper left side, an upper side, and a lower side in FIG. 1 are respectively defined as a left side, a right side, a front side, a rear side, an upper side and a lower side of the printer 1 and the cassette 7 mounted in the printer 1.

As illustrated in FIG. 1, the printer 1 includes a housing 2, and a cover 3. The housing 2 has generally a rectangular parallelepiped in shape. The cover 3 is pivotally movably supported by an upper rear end portion of the housing 2 for opening and closing an upper open end of the housing 2. An input portion 4 is provided at a left-upper corner portion of a front surface of the housing 2. Various information can be inputted in the printer 1 by user's operations to the input portion 4. A discharge opening 11 is formed in the front surface of the housing 2 at a position rightward of the input portion 4. The discharge opening 11 extends in an upward/downward direction and allows an interior and an exterior of the housing 2 to communicate with each other.

A cassette receiving portion 6 is provided at an upper portion of the housing 2. The cassette receiving portion 6 is recessed downward from an upper surface of the housing 2.

Figure 2:
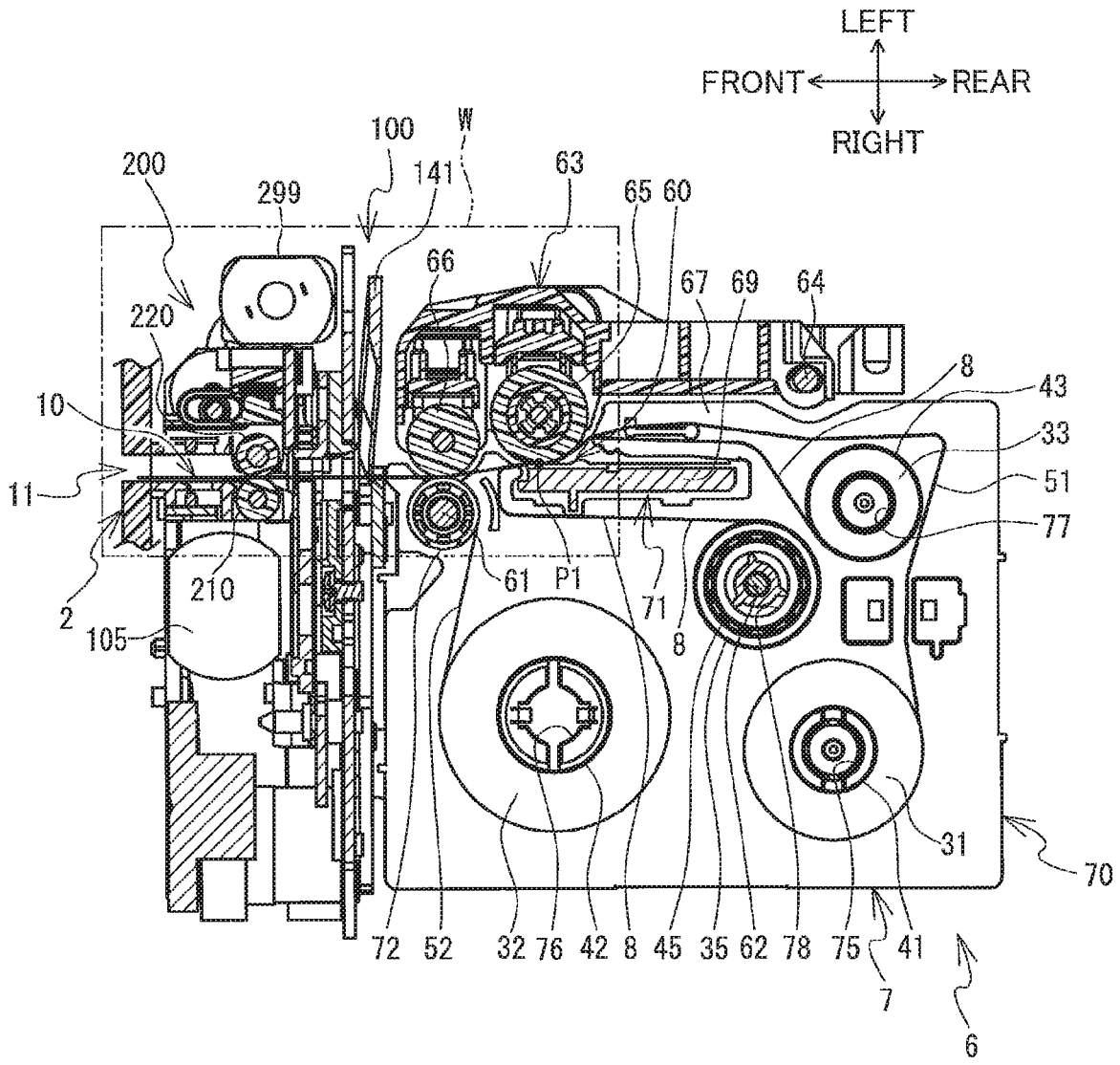
FIG. 2 is a cross-sectional view of the printer and the cassette 7 according to the embodiment taken along a line I-II in FIG. 1.

The cassette 7 is attachable to and detachable from the cassette receiving portion 6. The cassette 7 rotatably holds a tape 10 (FIG. 2) and an ink ribbon 8 (FIG. 2). Each of the tape 10 and the ink ribbon 8 has a width in a widthwise direction coincident with the upward/downward direction in the drawings.

As illustrated in FIG. 2, the cassette receiving portion 6 includes a thermal head 60, a head holder 69, a tape drive shaft 61, a ribbon take-up shaft 62, and a drive motor (not illustrated).

The thermal head 60 is provided at a left surface of the head holder 69. The thermal head 60 includes a plurality of heat generating elements arrayed with one another in the upward/downward direction. The head holder 69 is positioned at a left portion of the cassette receiving portion 6, and has a plate-like shape extending in a direction perpendicular to a leftward/rightward direction (i.e., in a frontward/rearward direction).

The tape drive shaft 61 is positioned frontward of the head holder 69. The ribbon take-up shaft 62 is positioned rightward of the head holder 69. The tape drive shaft 61 and the ribbon take-up shaft 62 are rotatable each about an axis thereof extending in the upward/downward direction. The tape drive shaft 61 and the ribbon take-up shaft 62 are drivingly connected to the drive motor (not illustrated). The tape drive shaft 61 and the ribbon take-up shaft 62 are interlockingly rotatable upon rotations of the drive motor.

A platen holder 63 is positioned leftward of the cassette receiving portion 6. The platen holder 63 has a rear end portion provided with a shaft 64 extending in the upward/downward direction. The platen holder 63 is pivotally movable about an axis of the shaft 64. The platen holder 63 supports a platen roller 65 and a conveyer roller 66. The platen roller 65 and the conveyer roller 66 are rotatable about respective axes extending in the upward/downward direction.

The platen roller 65 faces the thermal head 60 from a left side thereof. The conveyer roller 66 is at a position frontward of the platen roller 65 and faces the drive shaft 61 from a left side thereof. The platen holder 63 is pivotally movable in the leftward/rightward direction about the axis of the shaft 64 between a proximity position (FIG. 2) and a remote position (not illustrated).

The platen roller 65 and the conveyer roller 66 are positioned close to the thermal head 60 and the tape drive shaft 61, respectively, at the proximity position of the platen holder 63. The platen roller 65 and the conveyer roller 66 are positioned leftward away from the thermal head 60 and the tape drive shaft 61, respectively, at the remote position of the platen holder 63. The platen roller 65 is switchable to a drive-connection state to the drive motor in accordance with the pivotal movement of the platen holder 63 from the remote position to the proximity position. A position nipped between the platen roller 65 and the thermal head 66 when the platen holder 63 is at the proximity position will be referred to as "printing position P1" as depicted in FIGS. 2 and 3.

Figure 3:
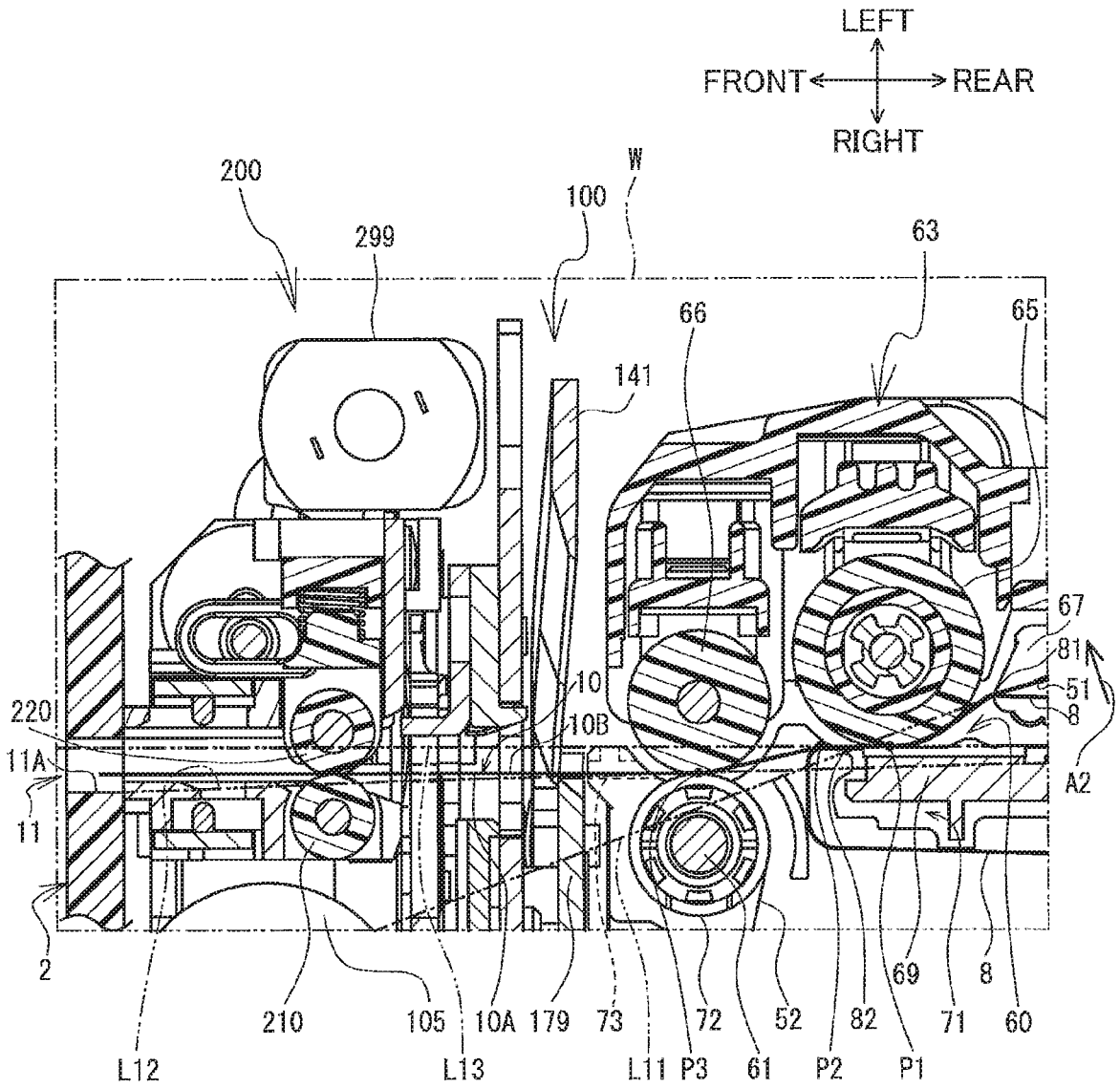
FIG. 3 is an enlarged cross-sectional view illustrating a region W in FIG. 2.

As illustrated in FIG. 3, a cutter unit 100 is provided inside the housing 2 at a position adjacent to and rearward of the discharge opening 11. The cutter unit 100 includes a fixed blade 179, a movable blade 141, and a cutter motor 105. The fixed blade 179 and the movable blade 141 are plate-like shaped each having a thickness in the frontward/rearward direction.

The fixed blade 179 is fixed at a position rightward of the tape 10 discharged out of the cassette 7. The fixed blade 179 has a left end having a blade edge extending in the upward/downward direction. The movable blade 141 has a right end having a blade edge extending in the upward/downward direction. The movable blade 141 has a lower end portion connected to a shaft member (not illustrated) extending in the frontward/rearward direction. The movable blade 141 is pivotally movable about an axis of the shaft member.

The movable blade 141 is drivingly connected to the cutter motor 105. Upon energization of the cutter motor 105, the blade edge of the movable blade 141 and the blade edge of the fixed blade 179 nip the tape 10 therebetween. Hence, the cutter unit 100 can cut the tape 10.

A discharge unit 200 is provided between the discharge opening 11 and the cutter unit 100 in the frontward/rearward direction. The discharge unit 200 includes a first roller 210, a second roller 220 and a discharge motor 299. The first roller 210 and the second roller 220 are arranged adjacent to each other in the leftward/rightward direction. The second roller 220 is positioned leftward of the first roller 210. The first roller 210 and second roller 220 are rotatable about respective axes extending in the upward/downward direction. The first roller 210 and the second roller 220 are configured to nip the tape 10 therebetween in the leftward/rightward direction.

The discharge motor 299 is drivingly connected to the second roller 220. The second roller 220 is configured to start rotating upon energization of the discharge motor 299. Following the rotation of the second roller 220, the first roller 210 is rotatable. Accordingly, the tape 10 is configured to be conveyed toward the discharge opening 11 by the rotations of the second roller 220 and the first roller 210 while being nipped between the first roller 210 and the second roller 220.

Figure 4:
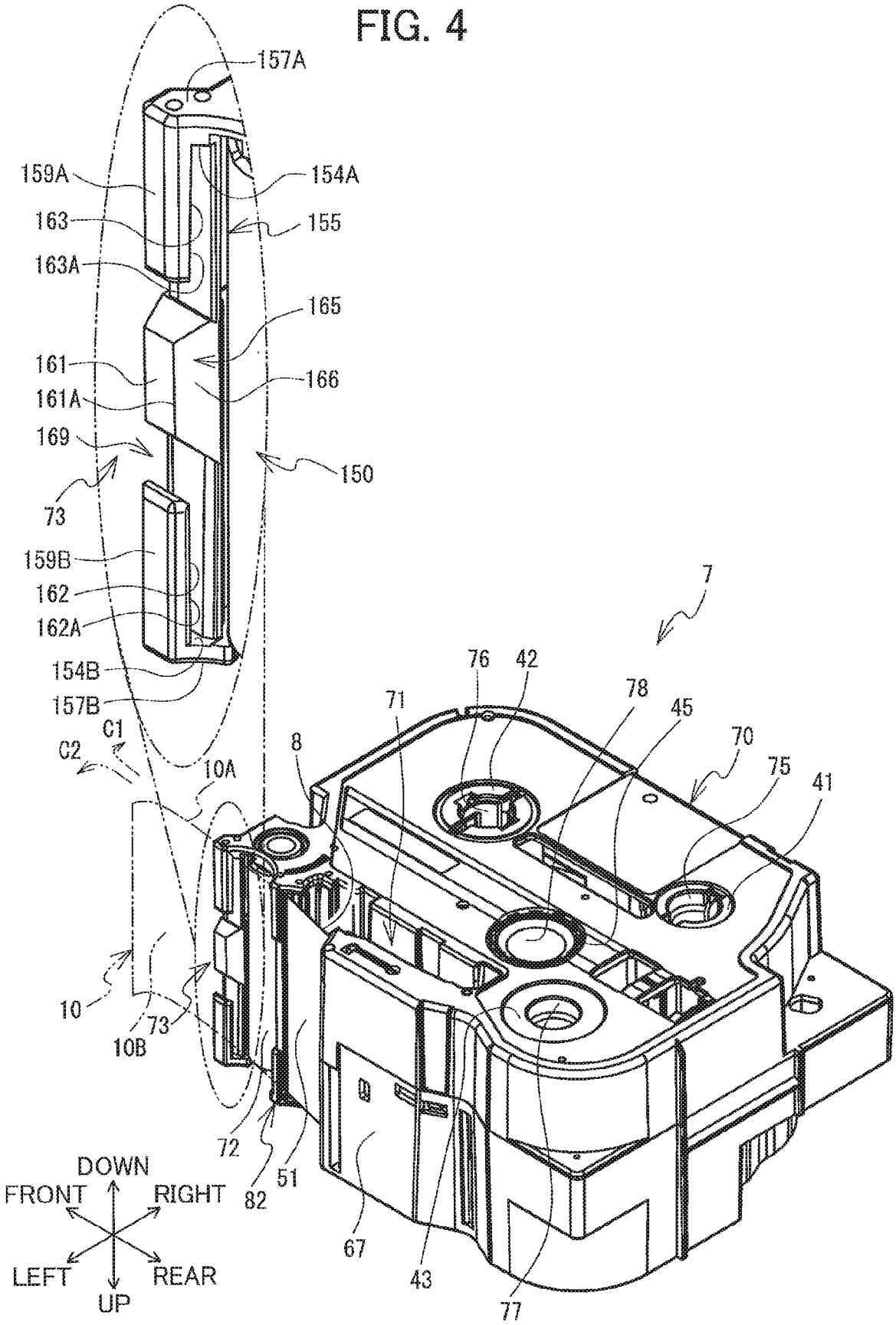
FIG. 4 is a perspective view of the cassette 7 according to the embodiment.

Next, the cassette 7 will be described with reference to FIGS. 2 and 4. In FIGS. 2 and 4, the tape 10 is indicated by a two-dotted chain line for better understanding to the drawings.

The cassette 7 is a laminate type cassette. The cassette 7 includes a case 70, an ejecting portion 73, and a guide 150. The case 70 is box shaped, and accommodates therein a tape drive roller 72, a first tape spool 41, a second tape spool 42, a ribbon spool 43, and a ribbon take-up spool 45. Further, the case 70 is formed with support holes 75, 76, 77, 78 those extending throughout a thickness of the case 70 in the upward/downward direction.

The tape drive roller 72 is positioned at a left front corner portion of the case 70, and has a hollow cylindrical shape extending in the upward/downward direction. The tape drive roller 72 is rotatably supported by the case 70. The tape drive shaft 61 is insertable into a hollow space of the tape drive roller 72.

The support hole 75 rotatably supports the first tape spool 41. A transparent film tape 51 is wound over the first tape spool 41 to constitute a first tape roll 31. The transparent film tape 51 is configured to be paid out from the first tape roll 31 by the rotation of the first tape roll 31 along with the rotation of the first tape spool 41 about an axis thereof extending in the upward/downward direction. That is, the first tape roll 31 is rotatable about the axis of the first tape spool 41.

The support hole 76 rotatably supports the second tape spool 42. A double-coated adhesive tape 52 is wound over the second tape spool 42 to constitute a second tape roll 32. The double-coated adhesive tape 52 is a double-sided tape whose one surface is covered with a release sheet. The double-coated adhesive tape 52 is configured to be paid out from the second tape roll 32 by the rotation of the second tape roll 32 along with the rotation of the second tape spool 42 about an axis thereof extending in the upward/downward direction. That is, the second tape roll 32 is rotatable about the axis of the second tape spool 42. The double-coated adhesive tape 52 has a tip end connected to the tape drive roller 72.

The support hole 77 rotatably supports the ribbon spool 43. A new or non-used ink ribbon 8 is wound over the ribbon spool 43 to constitute a ribbon roll 33. The ink ribbon 8 is configured to be paid out from the ribbon roll 33 by the rotation of the ribbon roll 33 along with the rotation of the ribbon spool 43 about an axis thereof extending in the upward/downward direction.

The support hole 78 rotatably supports the ribbon take-up spool 45. A used ink ribbon 8 is wound over the ribbon take-up spool 45 to constitute a ribbon take-up roll 35. The used ink ribbon 8 is configured to be wound over the ribbon take-up roll 35 by the rotation of the ribbon take-up roll 35 along with the rotation of the ribbon take-up spool 45 about an axis thereof extending in the upward/downward direction.

The ejecting portion 73 is at a left end portion and a front end portion of the case 70. The ejecting portion 73 is open in the frontward/rearward direction, and is configured to allow the tape 10 to be ejected therethrough toward the cutter unit 100. The guide 150 is provided at the ejecting portion 73. Details of the guide 150 will be described later.

A head opening 71 is provided in the case 70. The head opening 71 is an open area extending in the frontward/rearward direction and throughout the thickness of the case 70 in the upward/downward direction. The head opening 71 is open leftward. The thermal head 60 is insertable in the head opening 71.

Specifically, the case 70 has a left side portion provided with an arm portion 67 extending in the frontward/rearward direction. The arm portion 67 has a right side surface forming a part of the head opening 71. A first tape guide 81 (FIG. 3) is provided at a front end portion of the arm portion 67. The first tape guide 81 is an opening portion through which the ink ribbon 8 and the transparent film tape 51 (the transparent film tape 51 is positioned on the left of the leftward of the ink ribbon 8) are discharged.

The transparent film tape 51 and the ink ribbon 8 those discharged out of the first tape guide 81 are configured to pass through the head opening 71, and then directed toward a second tape guide 82. The second tape guide 82 is an opening portion positioned between the head opening 71 and the tape drive roller 72.

In the case 70, the ink ribbon 8 is separated from the transparent film tape 51 and is directed rightward at a portion between the second tape guide 82 and the tape drive roller 72. The ink ribbon 8 is then wound over the ribbon take-up roll 35. In the following description, the position at which the ink ribbon 8 is separated from the transparent film tape 51 will be referred to as "peeling position P2" (see FIG. 3). The peeling position P2 is at a position between the second tape guide 82 and the tape drive roller 72.

The transparent film tape 51 positioned forward of the peeling position P2 (after the ink ribbon 8 is peeled off) is directed to the tape drive roller 72 where the transparent film tape 51 is superposed with a left surface of the double-coated adhesive tape 52. In the attached state of the cassette 7 to the cassette receiving portion 6, the double-coated adhesive tape 52 and the transparent film tape 51 are nipped between the tape drive roller 72 and the conveyer roller 66 for sticking to each other.

In the following description, the position at which the double-coated adhesive tape 52 and the transparent film tape 51 are stuck to each other will be referred to as "sticking position P3" (see FIG. 3). Further, a combination of the double-coated adhesive tape 52 and the transparent film tape 51 (the transparent film tape 51 to which the double-coated adhesive tape 52 is adhered) will be occasionally and generically referred to as "tape 10". In the cassette 7 according to the embodiment, the double-coated adhesive tape 52 has rigidity higher than rigidity of the transparent film tape 51. Rigidity of the tape 10 varies depending on materials of the tape 10, and also depending on a shape or configuration of the tape 10 such as a width of the tape 10, a thickness of the tape 10, and presence/absence of surface irregularities of the tape 10.

Upon energization of the drive motor and the discharge motor 299, the platen roller 65, the tape drive roller 72, the conveyer roller 66, the first roller 210, and the second roller 220 convey the tape 10 and the ink ribbon 8. In the following description, a conveying direction of the tape 10 at a range from the first tape guide 81 to the discharge opening 11 will be referred to as "conveying direction". The conveying direction is generally the frontward/rearward direction. Hence, an upstream side in the conveying direction is a rearward direction, and a downstream side in the conveying direction is a frontward direction.

In FIG. 3, a first linear line L11, a second linear line L12, and a third linear line L13 are shown. The first linear line L11 extends through the first tape guide 81 and the second tape guide 82. The second linear line L12 extends through the sticking position P3 and one end (right end) 11A of the discharge opening 11. The one end 11A is positioned slightly rightward of the sticking position P3. Hence, the second linear line L12 is slightly inclined with respect to the frontward/rearward direction. The third linear line L13 extends through the printing position P1 and the peeling position P2, and generally extends in the frontward/rearward direction.

A structure of the guide 150 of the cassette 7 will be described next with reference to FIGS. 4 and 5.

The guide 150 is configured to guide the tape 10 toward the downstream side in the conveying direction. Here, the term "guide" implies not only a concept of restraining a conveying item (the tape 10 in the embodiment) from being offset from a predetermined region, but also a concept of positively contacting with the conveying item to deform the same.

The guide 150 includes a base 155, a base-protrusion 165, a pair of extension portions 157A and 157B, and a pair of arms 159A and 159B. The base 155 extends in the upward/downward direction, and is positioned at a left end portion of the ejecting portion 73. The base-protrusion 165 protrudes leftward from a generally center portion of the base 155 in the upward/downward direction. The base-protrusion 165 has a generally trapezoidal shape in a side view. The base-protrusion 165 has a first region 161 and a sloped region 166.

The first region 161 is a flat left end surface of the base-protrusion 165. That is, the first region 161 is a top surface of the trapezoidal-shape of the base-protrusion 165. The first region 161 is contactable with one surface of the tape 10. In the following description, one surface of the tape 10 in contact with the first region 161 will be referred to as a "first surface 10A", and a surface opposite to the first surface 10A will be referred to as a "second surface 10B". In the depicted embodiment, the first surface 10A is a right surface of the tape 10 (that is, a right surface of the double-coated adhesive tape 52), and the second surface 10B is a left surface of the tape 10 (that is, a left surface of the transparent film tape 51). Hereinafter, a direction from the first surface 10A toward the second surface 10B (leftward direction) will be referred to as "first direction" wherever appropriate. That is, at the guide 150, the first direction (the leftward direction) of the tape 10 coincides with a direction perpendicular to both of the conveying direction and an axis of the first tape roll 31 and away from the base 155 and the case 70.

The sloped region 166 is a sloped surface extending diagonally frontward and leftward from the generally center portion of the base 155. The sloped region 166 is connected to an upstream end (rear end) 161A of the first region 161 in the conveying direction. The sloped region 166 is inclined relative to the conveying direction to extend leftward toward downstream in the conveying direction. Put different way, the sloped region 166 is inclined rearward with increasing the distance from the upstream end 161A. The sloped region 166 is contactable with the first surface 10A and is configured to guide the tape 10 to the first region 161.

Each of the pair of extension portions 157A and 157B extends leftward from each end of the base 155 in the upward/downward direction. Each of the extension portions 157A and 157B has a flat end face facing with each other in the upward/downward direction. An end face 154A facing upward of the lower extension portion 157A and an end face 154B facing downward of the upper extension portion 157B function as a pair of guide regions 154A and 154B for guiding widthwise edges (upper and lower edges) of the tape 10. A minimum distance between the pair of guide regions 154A and 154B (distance M in FIG. 5) is slightly greater than the widthwise length of the tape 10 (transparent film tape 51 rolled in the form of the first tape roll 31).

Each of the pair of arms 159A and 159B extends toward each other from a left end of the corresponding one of the extension portions 157A and 157B. Each of the arms 159A and 159B is positioned outward of the base-protrusion 165 in the upward/downward direction. In other words, the arms 159A and 159B are arrayed with each other with a space 169 therebetween in the upward/downward direction. The space 169 is open leftward, which is a direction coincident with the direction in which the first region 161 faces.

In the following description, a right end surface 162 of the upper arm 159B will be referred to as a "second region 162", and a right end surface 163 of the lower arm 159A will be referred to as a "third region 163". The second region 162 and the third region 163 are flat planes contactable with the second surface 10B of the tape 10. Leftward/rightward positions of the second region 162 and the third region 163 are generally coincident with each other. The second region 162 is connected to the upper guide region 154B, and the third region 163 is connected to the lower guide region 154A. The second region 162 and third region 163 are respectively positioned rightward of the first region 161. In other words, the guide 150 is configured such that the first region 161 is positioned leftward (further in the first direction of the tape 10 at the guide 150) relative to each of the second region 162 and third region 163. Further, the second region 162 is positioned above the first region 161, and the third region 163 is positioned below the first region 161.

The thickness direction of the tape 10 positioned in the guide 150 is coincident with the leftward/rightward direction. Referring to FIG. 5, a first distance L1 between the first region 161 and the second region 162 in the leftward/rightward direction is substantially equal to a second distance L2 between the first region 161 and the third region 163 in the leftward/rightward direction. Preferably, the first distance L1 and the second distance L2 be equal to or less than 2 mm; more preferably, equal to or less than 1.5 mm; and furthermore preferably, equal to or less than 1.0 mm. In the present embodiment, each of the first distance L1 and the second distance L2 is 1 mm.

The first region 161 is overlapped with the second region 162 and the third region 163 in the conveying direction. Further, the upstream end 161A of the first region 161 is positioned frontward (downstream the conveying direction) of an upstream end 162A of the second region 162 and an upstream end 163A of the third region 163. Further, as illustrated in FIG. 3, at the ejecting portion 73, the first region 161 is positioned leftward of the first linear line L11 and the second linear line L12, and rightward of the third linear line L13.

Next, a printing process to be performed in the printer 1 will next be described with reference to FIGS. 1 through 5.

In the open state of the cover 3, the platen holder 63 is at the remote position. When the cassette 7 is attached to the cassette receiving portion 6 by a user with the cover 3 in the open state, the ribbon take-up shaft 62 is inserted in the ribbon take-up spool 45, and at the same time, the tape drive shaft 61 is inserted in the tape drive roller 72, and the head holder 69 is inserted in the head opening 71.

Then, the platen holder 63 moves from the remote position to the proximity position in association with closing of the cover 3. As a result, the platen roller 65 is pressed against the thermal head 60 with the ink ribbon 8 and the transparent film tape 51 interposed between the platen roller 65 and the thermal head 60. The conveyer roller 66 is pressed against the tape drive roller 72 with the double-coated adhesive tape 52 and the transparent film tape 51 interposed between the conveyer roller 66 and the tape drive roller 72.

Then, the drive motor is powered, so that the tape drive shaft 61, the platen roller 65, and the ribbon take-up shaft 62 rotate. The tape drive roller 72 is rotationally driven by the rotation of the tape drive shaft 61, and the conveyer roller 66 is rotated by the rotation of the tape drive roller 72. Hence, the double-coated adhesive tape 52, the transparent film tape 51, and the ink ribbon 8 are conveyed.

The double-coated adhesive tape 52 is paid out from the second tape roll 32. The transparent film tape 51 is paid out from the first tape roll 31. At the same time, the ink ribbon 8 is paid out from the ribbon roll 33. The transparent film tape 51 and the ink ribbon 8 are ejected through the first tape guide 81 and are directed to the printing position P1 by the rotation of the drive motor.

Ink contained in the ink ribbon 8 is transferred to the transparent film tape 51 by the heat generated at the thermal head 60, whereupon a character is printed on the transparent film tape 51 positioned at the printing position P1. Letters, figures, numerals, and marks are example of the character. The transparent film tape 51 and the used ink ribbon 8 are conveyed toward the second tape guide 82 by the rotation of the platen roller 65 and the ribbon take-up shaft 62.

After the ink ribbon 8 is entered into the second tape guide 82, the ink contained in the ink ribbon 8 is released from the ink ribbon 8 by the separation of the ink ribbon 8 from the transparent film tape 51 at the peeling position P2. The used ink ribbon 8 moved past the peeling position P2 is wound over the ribbon take-up roll 35 rotated by the ribbon take-up shaft 62. The printed transparent film tape 51 moved past the peeling position P2 is directed to the sticking position P3 by the rotation of the conveyer roller 66 and the tape drive roller 72.

At the sticking position P3, one surface of the double-coated adhesive tape 52 is stuck to the transparent film tape 51 moved past the second tape guide 82. Hence, the tape 10 is provided at the sticking position P3. The tape 10 is conveyed to the ejecting portion 73.

The tape 10 reaching the ejecting portion 73 is guided leftward and toward downstream side in the conveying direction by the sloped region 166 of the guide 150, and the tape 10 arrives at the space 169. At this time, the first surface 10A of the tape 10 is in contact with the first region 161, and the second surface 10A of the tape 10 is in contact with each of the second region 162 and the third region 163. Since the first region 161 is positioned leftward than each of the second region 162 and third region 163, the tape 10 at the guide 150 is deformed to be convex leftward (in the first direction) as illustrated in FIG. 5.

The transparent film tape 51 and the double-Coated adhesive tape 52 are initially wound over the first tape spool 41 and the second tape spool 42 to form the first tape roll 31 and the second tape roll 32, respectively. Hence, in a state where the transparent film tape 51 and the double-coated adhesive tape 52 are stuck to each other, restoration force for restoring originally winding shape is applied to the tape 10. In other words, the force for curving the tape 10 in thickness directions thereof is generated in the tape 10 as the tape 10 is conveyed toward the downstream side in the conveying direction. This curving behavior of the tape 10 will be referred to as "curling".

Specifically, a first force C1 (FIG. 4) directing rightward is applied to the tape 10 as the tape 10 extends toward the downstream side in the conveying direction by restoration of inherent winding shape of the transparent film tape 51. On the other hand, a second force C2 (FIG. 4) directing leftward is applied to the tape 10 as the tape 10 extends toward the downstream side in the conveying direction by restoration of inherent winding shape of the double-coated adhesive tape 52. The second force C2 is greater than the first force C1, since the rigidity of the double-coated adhesive tape 52 is higher than that of the transparent film tape 51.

Accordingly, the tape 10 is likely to be curled in a direction of the second force C2. That is, curling is generated in the tape 10 such that the second surface 10B is an inner periphery of the curl. According to the embodiment, the tape 10 is deformed to be convex in the first direction (leftward) while the tape 10 moves past the guide 150, the curling behavior of the tape 10 can be cured or corrected by the guide 150 into a flat posture generally parallel to the frontward/rearward direction.

The tape 10 moved past the ejecting portion 73 passes through the cutter unit 100, and is entered into a portion between the first roller 210 and the second roller 220 in the discharge unit 200. In the discharge unit 200, the tape 10 is conveyed toward the discharge opening 11 by the rotation of the discharge motor 299. After stopping the rotation of the drive motor and the discharge motor 299, the cutter motor 105 is energized, so that the tape 10 is cut by the cutter unit 100. The user can take out a cut segment of the printed tape 10 through the discharge opening 11.

As described above, the cassette 7 includes the tape 10 (the transparent film tape 51 to which the double-coated adhesive tape 52 is affixed), the ejecting portion 73, and the guide 150. The ejecting portion 73 is configured to discharge the tape 10 toward the cutter unit 100 and discharge unit 200. The guide 150 is provided at the ejecting portion 73. The guide 150 is configured to guide the tape 10 so that the tape 10 can be discharged properly through the ejecting portion 73. The guide 150 includes the first region 161, second region 162, and third region 163. The first region 161 is configured to contact the first surface 10A of the tape 10. The second region 162 and the third region 163 are configured to contact the second surface 10B of the tape 10 which is opposite the first surface 10A. In the upward/downward direction which is coincident with the widthwise direction of the tape 10, the guide 150 is configured such that: the first region 161 is positioned between the second region 162 and third region 163; the second region 162 is above the first region 161; and the third region 163 is positioned below the first region 161. That is, the second region 162, the first region 161 and the third region 163 are arranged in the recited order, from the top to the bottom. Further, the guide 150 is also configured such that: the first region 161 is positioned further in the first direction (leftward) relative to each of the second region 162 and third region 163.

Here, assume a possibility that an unexpected application of an external force to the tape 10 may cause deviation of the tape 10 from the ejecting portion 73, such as from the guide 150 through the space 169. With the guide 150 of the depicted embodiment, since the first region 161 is positioned further in the first direction (leftward) relative to the second region 162 and third region 163, the tape 10 is likely to make contact with each of the first region 161, second region 162 and third region 163, meaning that an increased area of contact between the tape 10 and the guide 150 can be ensured. Such an increase in contact are between the tape 10 and the guide 150 in turn increases frictional force between the tape 10 and the guide 150, thereby inhibiting deviation of the tape 10 from the guide 150 (ejecting portion 73).

Further, since the tape 10 is deformed to be convex in the first direction (leftward) at the ejecting portion 73 by the guide 150, curling nature of the tape 10 can be corrected into a flat posture generally parallel to the frontward/rearward direction while moving past the guide 150 of the ejecting portion 73. Consequently, the guide 150 can stably guide the tape 10 without any stagnation or jamming.

The guide 150 of the depicted embodiment is configured such that the tape 10 can be convex in the first direction (leftward), i.e., in the direction from the first surface 10A toward the second surface 10B, while being in contact with the first region 161, second region 162 and 163. Such arrangement of the first region 161, the second region 162 and the third region 163 to deform the tape 10 conveyed therealong to be convex leftward ensures contact of the tape 10 with each of the first region 161, the second region 162 and the third region 163. That is, the area of contact between the tape 10 and the guide 150 can be increased. The tape 10 is therefore less likely to be disengaged from the guide 150 (or the ejecting portion 73). Further, deforming the tape 10 to be convex in the first direction (leftward) at the guide 150 can help correcting the curing behavior of the tape 10.

The cassette 7 further includes the sloped 166 connected to the upstream end 161A of the first region 161 in the conveying direction. The sloped region 166 is sloped to extend in the first direction toward downstream in the conveying direction. Since the guide 150 also includes the sloped region 166, the sloped region 166 can realize smooth movement of the tape 10 to the first region 161, thereby facilitating discharge of the tape 10 through the ejecting portion 73.

The second surface 10B of the tape 10 forms an inner peripheral surface of the curl of the tape 10 generated as a result of curving behavior of the tape 10. The second surface 10B of the tape 10 is configured to contact the second region 162 and third region 163 while moving past the guide 150. In this way, since a plurality of regions of the guide 150 can contact the inner peripheral surface (second surface 10B) of the tape 10, the curling nature of the tape 10 can be easily corrected or cured.

The tape 10 includes the transparent film tape 51 and the double-coated adhesive tape 52. The second surface 10B of the tape 10 is an outer surface (left surface) of the transparent film tape 51 whose rigidity is smaller than the rigidity of the double-coated adhesive tape 52 (see FIG. 3). Accordingly, even if the tape 10 is applied with a force to form curling with the second surface 10B being the inner peripheral surface of the curl, the contact of the tape 10 with each of the second region 162 and third region 163 provides a force strong enough to correct the curling to cure the curling behavior of the tape 10 at the ejecting portion 73 by the guide 150.

The guide 150 includes the upper and lower guide regions 154B and 154A configured to guide the widthwise edges (upper and lower edges) of the tape 10. The upper and lower guide regions 154B and 154A are respectively connected to the second region 162 and third region 163. Since the upper and lower guide regions 154B and 154A can guide the widthwise edges of the tape 10, more stable guiding of the tape 10 can be realized by the guide 150 in the cassette 7.

The first linear line L11 extends through the first tape guide 81 and the second tape guide 82. The transparent film tape 51 and ink ribbon 8 discharged through the first tape guide 81 move past the head opening 71 and reach the second tape guide 82 which is an open portion of the cassette 7. In other words, the first tape guide 81 is positioned upstream of the head opening 71 in the conveying direction, while the second tape guide 82 is positioned downstream of the head opening 71 in the conveying direction. Referring to FIG. 3, the first region 161 is positioned offset in a second direction (indicated by an arrow A2) from to the first linear line L11 at the ejecting portion 73, the second direction being a defined as a direction coincident with the first direction of the tape 10 (the direction from the first surface 10A to the second surface 10B) at the head opening 71. This structure can restrain excessive deformation of the transparent film tape 51 that is discharged from the second tape guide 82 toward the guide 150.

Further, each of the first distance L1 and second distance L2 is equal to or less than 2 mm in the depicted embodiment. With this structure, the guide 150 can deform the tape 10 in contact with the guide 150 to a suitable degree. Incidentally, the tape 10 may be deformed by the guide 150 to a more suitable degree with the first distance L1 and second distance L2 being equal to or less than 1.5 mm; and to a further more suitable degree with the with the first distance L1 and second distance L2 being equal to or less than 1.0 mm.

In the guide 150 of the embodiment, the second region 162 and third region 163 are aligned with each other with the space 169 interposed therebetween in the upward/downward direction. In other words, the second region 162 and third region 163 are spaced away from each other in the upward/downward direction. The space 169 is open leftward, i.e., in the first direction in which the first region 161 of the base-protrusion 165 faces. With this structure, even if the tape 10 is to be deviated from the ejecting portion 73 (guide 150), the deviated tape 10 tends to easily come back to the position inside the guide 150 through the space 169.

The cassette 7 of the described embodiment is attachable to and detachable from the cassette receiving portion 6 of the printer 1 having the discharge opening 11. Here, the second linear line L12 extends through the sticking position P3 and the one end (right end) 11A of the discharge opening 11. The one end 11A is one end of the discharge opening 11 in a third direction (rightward direction) which is coincident with a direction from the transparent film tape 51 toward the double-coated adhesive tape 52 at the sticking position P3. The first region 161 is positioned offset in a direction opposite the third direction (i.e., in the leftward direction) from the second linear line 12. With this structure, since the guide 150 can guide the tape 10 at a position leftward of the one end 11A of the discharge opening 11 (i.e., at a position opposite from the one end 11A of the tape 10 in the in the direction opposite to the third direction), the tape 10 ejected from the ejecting portion 73 is less likely to be moved further in the third direction beyond the one end 11A of the discharge opening 11. Accordingly, jamming of the tape 10 at the discharge opening 11 as a result of the displacement of the tape 10 in the third direction beyond the one end 11A can be restrained in the cassette 7.

The cassette 7 of the described embodiment is attachable to and detachable from the cassette receiving portion 6 of the printer 1 including the thermal head 60. The thermal head 60 is configured to perform printing on the transparent film tape 51 through the ink ribbon 8 superposed with the transparent film tape 51. The first region 161 is positioned offset in a fourth direction (rightward) from the third linear line L13. The third linear line L13 extends through the printing position P1 (at which the printing by the thermal head 60 is performed) and the peeling position P2 (at which the ink ribbon 8 is separated from the transparent film tape 51). The fourth direction is a direction toward the thermal head 60 from the tape 10 at the printing position P1. Since the first region 161 is positioned offset in the fourth direction (rightward) from the third linear line L13, the guide 150 can easily come into contact with the tape 10 moved past the peeling position P2.

The present disclosure is not limited to the above described embodiment.

For example, a receptor type cassette or a thermal type cassette is available, instead of the laminate type cassette 7. Regarding the receptor type cassette (hereinafter simply referred to as "first cassette"), a receptor tape (hereinafter simply referred to as a "tape 12") is wound over the first tape spool 41 supported by the support hole 75, the second tape spool 42 is not provided, and the ribbon spool 43 is supported by the support hole 77. Regarding the thermal type cassette, a heat sensitive tape or a stencil tape is wound over the first tape spool 41 supported by the support hole 75, and the second tape spool 42 and the ribbon spool 43 are not provided.

Further, the rigidity of the transparent film tape 51 may be higher than the rigidity of the double-coated adhesive tape 52. In the latter case, the tape may be curled rightward (in the direction of the arrow C1) at the position frontward of the ejecting portion 73 as extending downstream in the conveying direction.

Further, in the above-described embodiment, the ejecting portion 73 is positioned downstream of the tape drive roller 72 in the conveying direction. However, the ejecting portion 73 may be positioned upstream of the tape drive roller 72 in the conveying direction. For example, the ejecting portion 73 may be positioned at the second tape guide 82. In the latter case, the guide 150 is provided at the second tape guide 82.

A guide 250 according to a first modification to the embodiment will next be described with reference to FIG. 6, wherein like parts and components are designated by the same reference numerals as those shown in FIGS. 1 through 5. The same is true with respect to second and third modifications described later.

Figure 5:
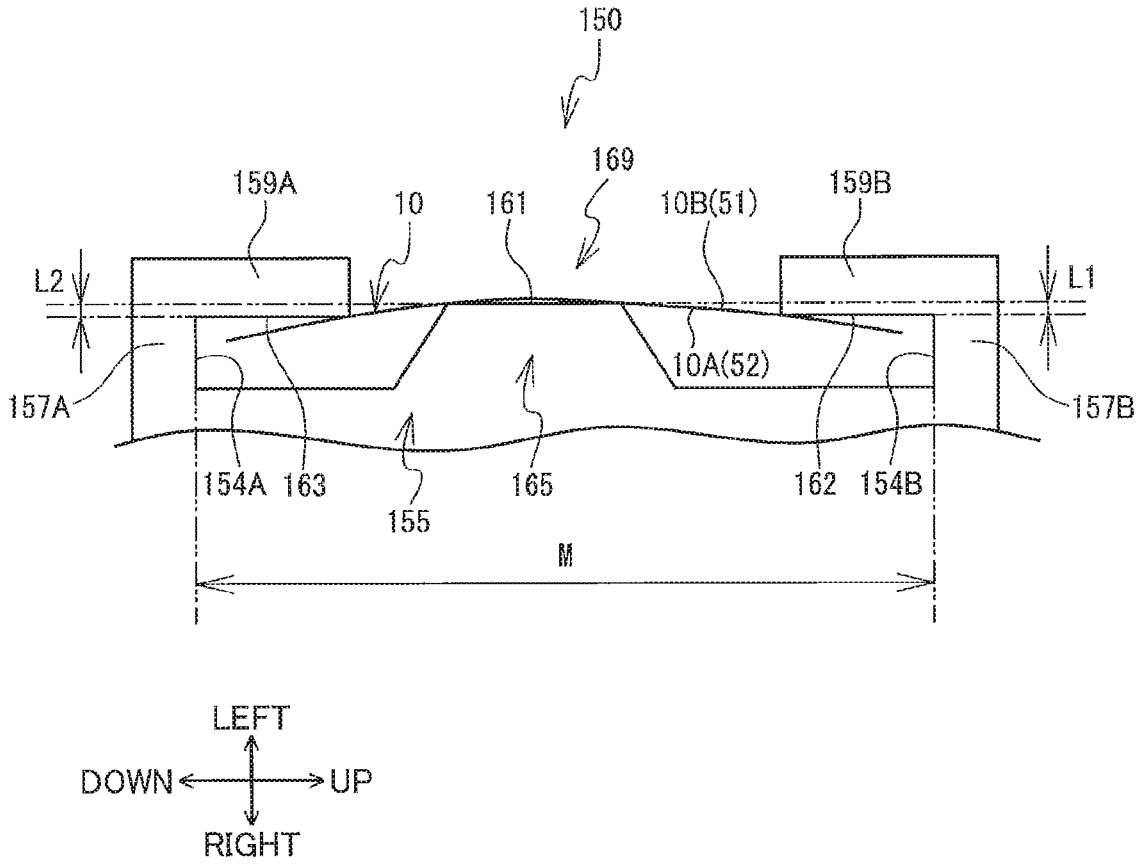
FIG. 5 is a front view illustrating a guide 150 in the cassette 7 according to the embodiment.
Figure 6:
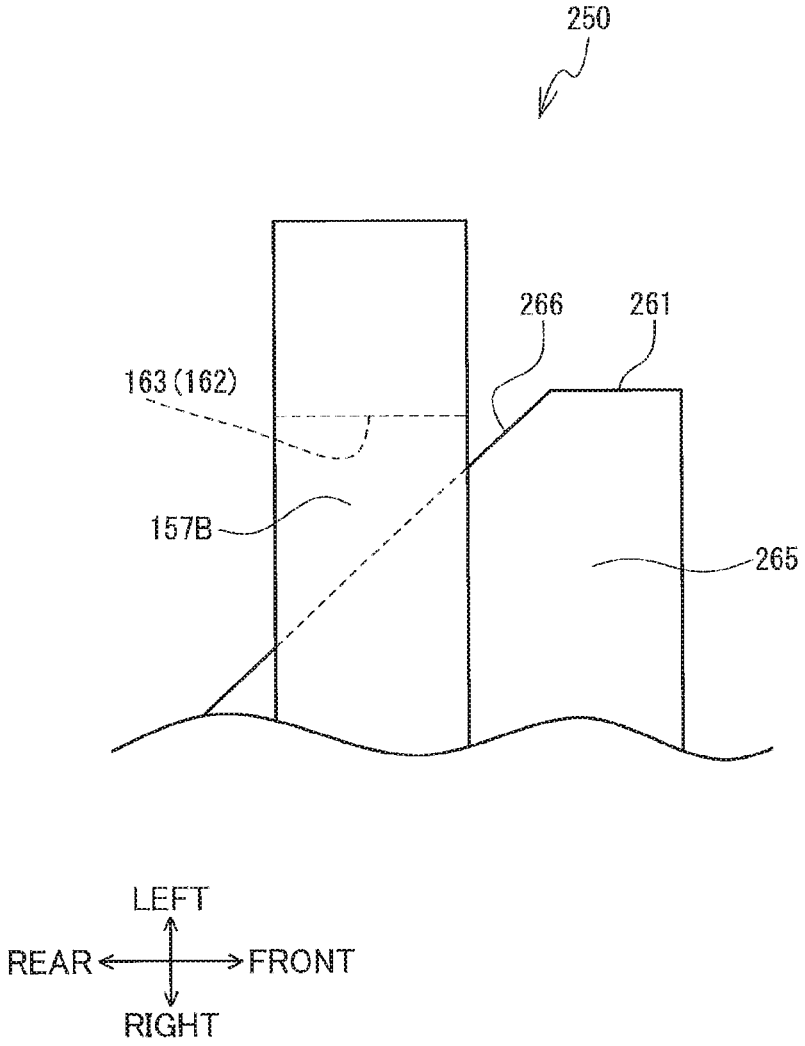
FIG. 6 is a bottom view illustrating a guide 250 according to a first modification to the guide 150 of the embodiment.

The guide 250 includes abase 265 instead of the base 155 (FIG. 5). The base 265 extends in the upward/downward direction, and has a flat left end surface 261 functioning as a first region 261. The first region 261 is positioned further in the first direction (leftward) than the second region 162 and the third region 163.

The first region 261 in its entirety is positioned downstream of the second region 162 and the third region 163 in the conveying direction. In other words, the base 265 has a part positioned offset from each of the second region 162 and the third region 163 in the conveying direction. The base 265 also has a tapered portion whose sloped left end surface 266 serving as a sloped region 266. The sloped region 266 is a sloped surface connected to an upstream end of the first region 261 in the conveying direction. The sloped region 266 is inclined toward the second region 162, that is, inclined to extend in the first direction (leftward) toward downstream in the conveying direction (frontward).

According to the first modification, the first region 261 has at least a portion positioned offset from each of the second region 162 and third region 163 in the conveying direction of the tape 10. A contacting area of the tape 10 with the guide 250 is elongated in the conveying direction. Therefore, an increased contacting area between the tape 10 and the guide 250 can be provided. Hence, the tape 10 is further less likely to disengage from the guide 250.

Figure 7:
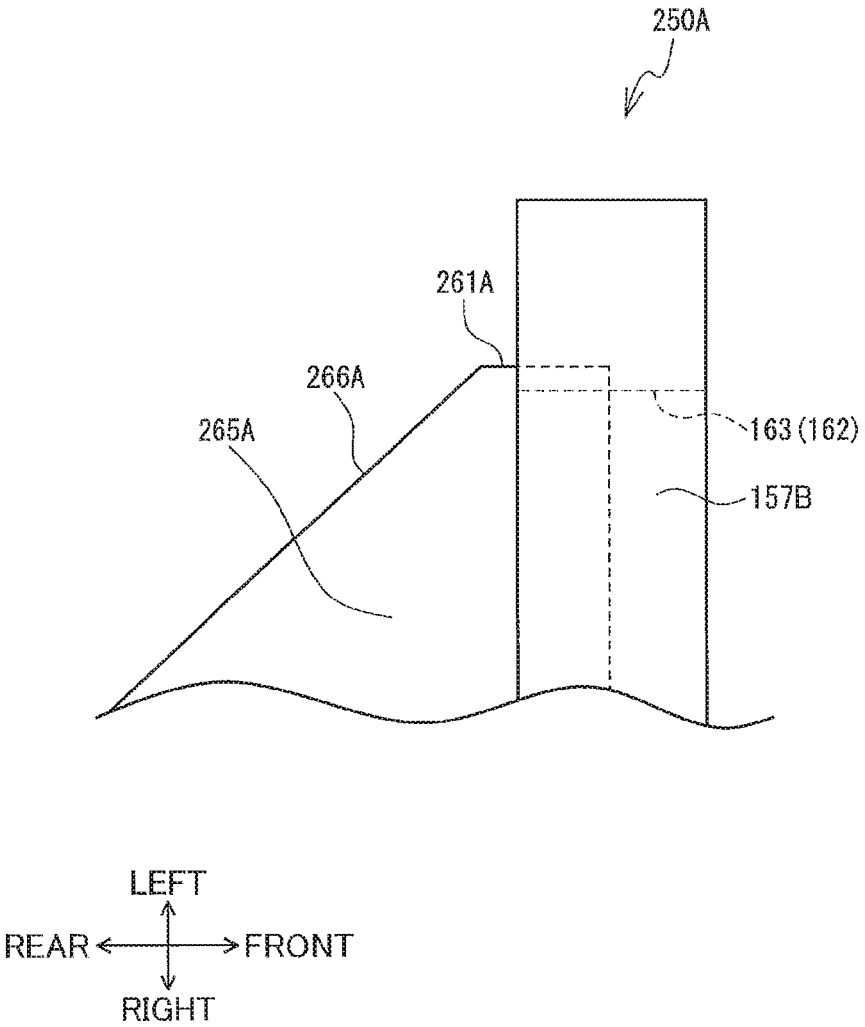
FIG. 7 is a bottom view illustrating a guide 250A according to a second modification to the guide 150 of the embodiment.

A guide 250A according to the second modification to the embodiment will be described with reference to FIG. 7.

The guide 250A is similar to the guide 250 of the first modification except a base 265A. The guide 250A includes the base 265A, instead of the base 265 (FIG. 6). The base 265A has a flat left end surface 261A functioning as a first region 261A. The first region 261A has a rear end portion positioned upstream of the second region 162 and the third region 163 in the conveying direction. The first region 261A has a front end portion overlapped with the second region 162 and the third region 163 in the conveying direction (frontward/rearward direction). The base 265A also includes a tapered portion whose sloped left end surface serves as a sloped region 266A. The sloped region 266A is a sloped surface connected to an upstream end of the first region 261A in the conveying direction. The sloped region 266A is inclined toward the second region 162, that is, inclined relative to the conveying direction to extend in the first direction (leftward) toward downstream in the conveying direction (frontward).

According to the second modification, the rear end portion of the first region 261A is positioned upstream of the second region 162 and the third region 163 in the conveying direction. In other words, at least a portion of the first region 261A is positioned offset from each of the second region 162 and the third region 163 in the conveying direction. More specifically, this portion of the first region 261A is positioned upstream of the second and third regions 162 and 163 in the conveying direction. In a case where the tape 10 is released or disengaged from the ejecting portion 73, resetting of the tape 10 at the ejecting portion 73 by the user is required. However, according to the guide 250A of the second embodiment, a leading edge of the tape 10 (most downstream end of the tape 10) is easily contacted with the sloped region 266A and the first region 261A sequentially. Accordingly, the tape 10 can be easily guided by the second region 162 and the third region 163. As a result, even if disengagement of the tape 10 occurs, the tape 10 disengaged from the ejecting portion 73 can again be positioned at the ejecting portion 73.

Figure 8:
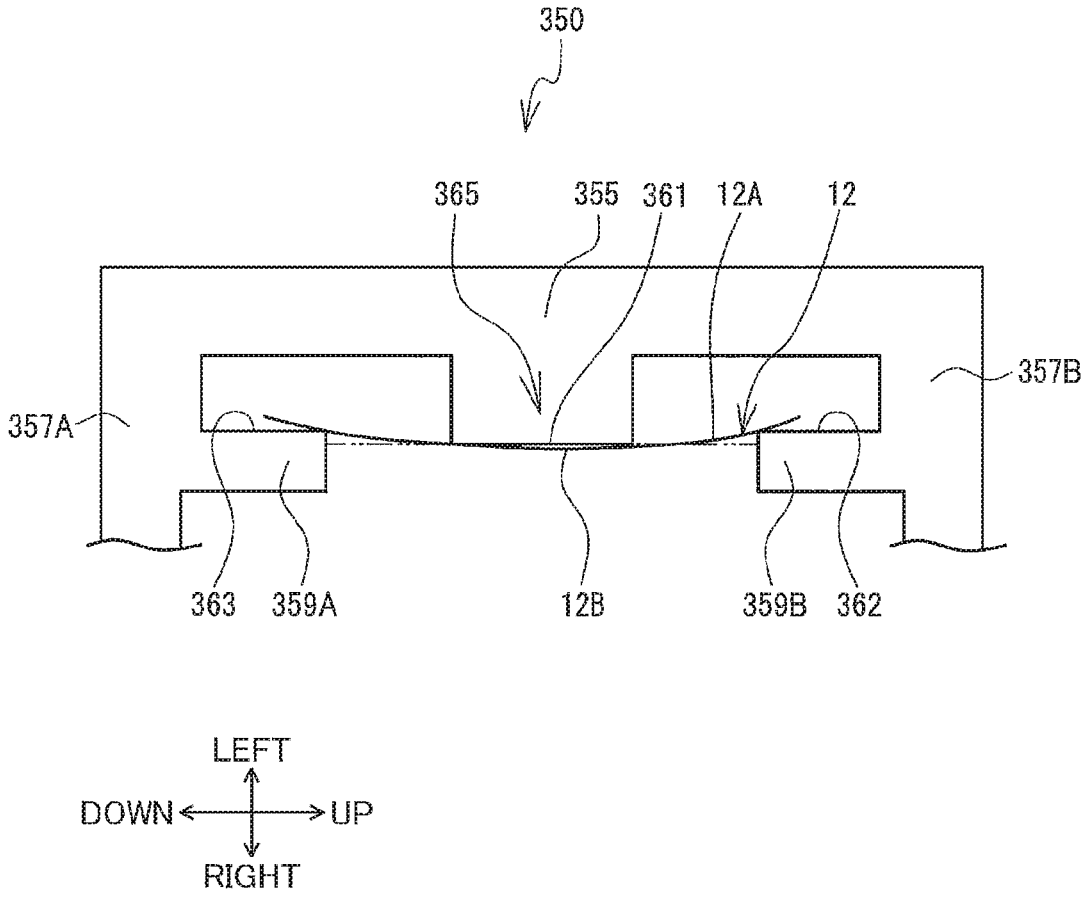
FIG. 8 is a front view illustrating a guide 350 according to a third modification to the guide 150 of the embodiment.

A guide 350 according to the third modification to the embodiment will be described with reference to FIG. 8.

The guide 350 is provided at the ejecting portion 73 (FIG. 4). The guide 350 is one of the components of the receptor type cassette (first cassette) using the receptor tape (the tape 12).

The guide 350 includes a base 355, a base-protrusion 365, a pair of extension portions 357A and 357B, and a pair of arms 359A and 359B. The base 355 extends in the upward/downward direction. The base-protrusion 365 protrudes rightward from a generally center portion of the base 355 in the upward/downward direction. The base-protrusion 365 has a flat right end surface serving as a flat first region 361. Each of the pair of extension portions 357A and 357B extends rightward from each end portion in the upward/downward direction of the base 355. The arms 359A and 359B respectively extend toward each other in the upward/downward direction. The upper arm 359B has a left end surface 362 serving as a second region 362, and the lower arm 359A has a left end surface 363 serving as a third region 363. The second region 362 and the third region 363 are flat surfaces. The first region 361 is positioned rightward of the second region 362 and the third region 363.

The tape 12 has a left end surface (first surface 12A) in contact with the first region 361. The tape 12 has a right end surface (second surface 12B) opposite the first surface 12A. The second surface 12B (the right end surface) of the tape 12 is in contact with the second region 362 and the third region 363. That is, in the third modification, the direction from the first surface 12A toward the second surface 12B is a rightward direction.

According to the third modification, the second surface 12B is the surface on which printing is performed by the thermal head 60. The second surface 12B of the tape 12 is in contact with both of the second region 362 and the third region 363. Accordingly, this structure of the third modification can disperse friction force generated by the contact of the guide 350 with the second surface 12B which is subjected to printing. Therefore, blurred character printing on the second surface 12B can be avoided.

While the description has been made in detail with reference to the specific embodiment and modifications thereof, it would be apparent to those skilled in the art that various changes and further modifications may be made therein without departing from the scope of the above described embodiment.

<Remarks>

The cassette 7 is an example of a cassette. The tapes 10 and 12 are examples of a tape. The first surfaces 10A and 12A are examples of a first surface of the tape, and the second surfaces 10B and 12B are examples of a second surface of the tape. The ejecting portion 73 is an example of an ejecting portion. The guides 150, 250, 250A and 350 are examples of a guide. The first regions 161, 261, 261A and 361 are examples of a first region. The second regions 162 and 362 are examples of a second region. The third regions 163 and 363 are examples of a third region. The leftward direction is an example of a first direction of the tape at the guide. The sloped regions 166, 266 and 266A are examples of a sloped region. The transparent film tape 51 is an example of a first tape. The double-coated adhesive tape 52 is an example of a second tape. The upper guide region 154B is an example of a first guide region. The lower guide region 154A is an example of a second guide region. The case 70 is an example of a case. The first tape guide 81 is an example of a first guide. The second tape guide 82 is an example of a second guide. The first distance L1 is an example of a first distance. The second distance L2 is an example of a second distance. The printing position P1 is an example of a printing position. The peeling position P2 is an example of a peeling position. The sticking position P3 is an example of a sticking position. The first linear line L11 is an example of a first imaginary line. The second linear line L12 is an example of a second imaginary line. The third linear line L13 is an example of a third imaginary line.

What is claimed is:

1. A cassette comprising:

a tape having a first surface and a second surface opposite each other, the tape having a thickness in a first direction defined as a direction from the first surface to the second surface, and the tape having a width in a widthwise direction perpendicular to the first direction;

an ejecting portion configured to discharge the tape in a conveying direction; and a guide provided at the ejecting portion and configured to guide the tape in the conveying direction, the guide comprising:

a first region in contact with the first surface of the tape at the guide;

a second region in contact with the second surface of the tape at the guide; and a third region in contact with the second surface of the tape at the guide, the first region being positioned between the second region and the third region in the widthwise direction of the tape at the guide, the first region being positioned further in the first direction of the tape positioned at the guide relative to the second region and the third region.

2. The cassette according to claim 1, wherein the first region has a portion positioned offset from the second region and the third region in the conveying direction.

3. The cassette according to claim 2, wherein the portion of the first region is positioned upstream of the second region and the third region in the conveying direction.

4. The cassette according to claim 2, wherein the portion of the first region is positioned downstream of the second region and the third region in the conveying direction.

5. The cassette according to claim 1, wherein the guide further comprises a sloped region connected to an upstream edge of the first region in the conveying direction, the sloped region being sloped to extend in the first direction toward downstream in the conveying direction.

6. The cassette according to claim 1, wherein the tape is in a form of a tape roll, and wherein the second surface of the tape is an inner surface of a curl of the tape, the curl being an inherent nature originated from a rolled shape of the tape.

7. The cassette according to claim 1, wherein the second surface of the tape is a surface to be printed.

8. The cassette according to claim 1, wherein the tape comprises:

a first tape provided in a form of a first roll, the first tape having the first tape having a first rigidity; and a second tape provided in a form of a second roll, the second tape paid out from the second roll being configured to be overlapped with the first tape paid out from the first roll, the second tape having a second rigidity, wherein the second surface is a surface of the first tape in a case where the first rigidity is lower than the second rigidity, and wherein the second surface is a surface of the second tape in a case where the second rigidity is lower than the first rigidity.

9. The cassette according to claim 1, wherein the guide further comprises:

a first guide region connected to the second region; and a second guide region connected to the third region, the first guide region and the second guide region being configured to guide widthwise ends of the tape in the widthwise direction.

10. The cassette according to claim 1, further comprising:

a case formed with a head opening in which a thermal head of a printing device is insertable;

a first guide positioned upstream of the head opening in the conveying direction and configured to guide the tape in the conveying direction; and a second guide positioned downstream of the head opening in the conveying direction and configured to guide the tape conveyed from the first guide toward the ejecting portion in the conveying direction, wherein the first region is positioned offset in a second direction from a first imaginary line connecting the first guide and the second guide, the second direction being coincident with the first direction of the tape at the head opening.

11. The cassette according to claim 1, wherein the first region and the second region define a first distance therebetween in the first direction of the tape at the guide, the first distance being equal to or smaller than 2 mm, and wherein the first region and the third region define a second distance therebetween in the first direction of the tape at the guide, the second distance being equal to or smaller than 2 mm.

12. The cassette according to claim 1, wherein the second region and the third region are arrayed with each other with a space therebetween in the widthwise direction, the first region facing the space, and the space being open in the first direction of the tape at the guide.

13. The cassette according to claim 1, wherein the cassette is attachable to and detachable from a printing device including a discharge opening, wherein the tape comprises:

a first tape provided in a form of a first roll; and a second tape provided in a form of a second roll, the second tape paid out from the second roll being configured to be overlapped with and stuck to the first tape paid out from the first roll at a sticking position, a direction from the first tape to the second tape at the sticking position being defined as a third direction, the discharge opening having one end in the third direction, wherein the first region is positioned offset in a direction opposite the third direction from a second imaginary line connecting the sticking position and the one end of the discharge opening in the third direction.

14. The cassette according to claim 1, further comprising a roll of an ink ribbon configured to be overlapped with the tape paid out from a roll of the tape, wherein the cassette is attachable to and detachable from a printing device including a print head, the print head being configured to perform printing on the tape overlapped with the ink ribbon at a printing position in an attached state of the cassette to the printing device, the ink ribbon being separated away from the tape at a peeling position after the printing is performed by the print head at the printing position in the attached state of the cassette to the printing device, a direction from the tape to the print head at the printing position being defined as a fourth direction, and wherein the first region is positioned offset in the fourth direction from a third imaginary line connecting the printing position and the peeling position.

15. A cassette comprising:

a tape having a first surface and a second surface opposite each other, the tape having a thickness in a first direction defined as a direction from the first surface to the second surface, and the tape having a width in a widthwise direction perpendicular to the first direction;

an ejecting portion configured to discharge the tape in a conveying direction; and a guide provided at the ejecting portion and configured to guide the tape in the conveying direction, the guide comprising:

a first region in contact with the first surface of the tape at the guide;

a second region in contact with the second surface of the tape at the guide; and a third region in contact with the second surface of the tape at the guide, the first region being positioned between the second region and the third region in the widthwise direction of the tape at the guide, wherein, at the guide, the tape in contact with each of the first region, the second region and the third region is deformed to be convex in the first direction.

16. The cassette according to claim 15, wherein the first region has a portion positioned offset from the second region and the third region in the conveying direction.

17. The cassette according to claim 16, wherein the portion of the first region is positioned upstream of the second region and the third region in the conveying direction.

18. The cassette according to claim 16, wherein the portion of the first region is positioned downstream of the second region and the third region in the conveying direction.

19. The cassette according to claim 15, wherein the guide further comprises a sloped region connected to an upstream edge of the first region in the conveying direction, the sloped region being sloped to extend in the first direction toward downstream in the conveying direction.

20. The cassette according to claim 15, wherein the tape is in a form of a tape roll, and wherein the second surface of the tape is an inner surface of a curl of the tape, the curl being an inherent nature originated from a rolled shape of the tape.

21. The cassette according to claim 15, wherein the second surface of the tape is a surface to be printed.

22. The cassette according to claim 15, wherein the tape comprises:

a first tape provided in a form of a first roll, the first tape having the first tape having a first rigidity; and a second tape provided in a form of a second roll, the second tape paid out from the second roll being configured to be overlapped with the first tape paid out from the first roll, the second tape having a second rigidity, wherein the second surface is a surface of the first tape in a case where the first rigidity is lower than the second rigidity, and wherein the second surface is a surface of the second tape in a case where the second rigidity is lower than the first rigidity.

23. The cassette according to claim 15, wherein the guide further comprises:

a first guide region connected to the second region; and a second guide region connected to the third region, the first guide region and the second guide region being configured to guide widthwise ends of the tape in the widthwise direction.

24. The cassette according to claim 15, further comprising:

a case formed with a head opening in which a thermal head of a printing device is insertable;

a first guide positioned upstream of the head opening in the conveying direction and configured to guide the tape in the conveying direction; and a second guide positioned downstream of the head opening in the conveying direction and configured to guide the tape conveyed from the first guide toward the ejecting portion in the conveying direction, wherein the first region is positioned offset in a second direction from a first imaginary line connecting the first guide and the second guide, the second direction being coincident with the first direction of the tape at the head opening.

25. The cassette according to claim 15, wherein the first region and the second region define a first distance therebetween in the first direction of the tape at the guide, the first distance being equal to or smaller than 2 mm, and wherein the first region and the third region define a second distance therebetween in the first direction of the tape at the guide, the second distance being equal to or smaller than 2 mm.

26. The cassette according to claim 15, wherein the second region and the third region are arrayed with each other with a space therebetween in the widthwise direction, the first region facing the space, and the space being open in the first direction of the tape at the guide.

27. The cassette according to claim 15, wherein the cassette is attachable to and detachable from a printing device including a discharge opening, wherein the tape comprises:

a first tape provided in a form of a first roll; and a second tape provided in a form of a second roll, the second tape paid out from the second roll being configured to be overlapped with and stuck to the first tape paid out from the first roll at a sticking position, a direction from the first tape to the second tape at the sticking position being defined as a third direction, the discharge opening having one end in the third direction, wherein the first region is positioned offset in a direction opposite the third direction from a second imaginary line connecting the sticking position and the one end of the discharge opening in the third direction.

28. The cassette according to claim 15, further comprising a roll of an ink ribbon configured to be overlapped with the tape paid out from a roll of the tape, wherein the cassette is attachable to and detachable from a printing device including a print head, the print head being configured to perform printing on the tape overlapped with the ink ribbon at a printing position in an attached state of the cassette to the printing device, the ink ribbon being separated away from the tape at a peeling position after the printing is performed by the print head at the printing position in the attached state of the cassette to the printing device, a direction from the tape to the print head at the printing position being defined as a fourth direction, and wherein the first region is positioned offset in the fourth direction from a third imaginary line connecting the printing position and the peeling position.

* * * * *